US007411360B2

(12) United States Patent
Henry

(10) Patent No.: US 7,411,360 B2
(45) Date of Patent: Aug. 12, 2008

(54) APPARATUS AND METHOD FOR STRIKING A FLUORESCENT LAMP

(75) Inventor: George C. Henry, Somis, CA (US)

(73) Assignee: Microsemi Corporation, Irvine, CA (US)

( * ) Notice: Subject to any disclaimer, the term of this patent is extended or adjusted under 35 U.S.C. 154(b) by 0 days.

(21) Appl. No.: 11/868,229

(22) Filed: Oct. 5, 2007

(65) Prior Publication Data

US 2008/0024075 A1 Jan. 31, 2008

Related U.S. Application Data

(63) Continuation of application No. 11/255,563, filed on Oct. 21, 2005, now Pat. No. 7,279,852, which is a continuation of application No. 10/453,760, filed on Jun. 3, 2003, now Pat. No. 6,979,959.

(60) Provisional application No. 60/433,557, filed on Dec. 13, 2002.

(51) Int. Cl.
*G05F 1/00* (2006.01)

(52) U.S. Cl. ..... 315/307; 315/291; 315/224; 315/DIG. 7

(58) Field of Classification Search ..... 315/291, 315/307, 224, 225, DIG. 5, DIG. 7
See application file for complete search history.

(56) References Cited

U.S. PATENT DOCUMENTS

| | | | |
|---|---|---|---|
| 2,429,162 | A | 10/1947 | Russell et al. |
| 2,440,984 | A | 5/1948 | Summers |
| 2,572,258 | A | 10/1951 | Goldfield et al. |
| 2,965,799 | A | 12/1960 | Brooks et al. |
| 2,968,028 | A | 1/1961 | Eilichi et al. |
| 3,141,112 | A | 7/1964 | Eppert |
| 3,449,629 | A | 6/1969 | Wigert et al. |
| 3,565,806 | A | 2/1971 | Ross |
| 3,597,656 | A | 8/1971 | Douglas |
| 3,611,021 | A | 10/1971 | Wallace |
| 3,683,923 | A | 8/1972 | Anderson |
| 3,737,755 | A | 6/1973 | Calkin et al. |
| 3,742,330 | A | 6/1973 | Hodges et al. |
| 3,916,283 | A | 10/1975 | Burrows |
| 3,936,696 | A | 2/1976 | Gray |
| 3,944,888 | A | 3/1976 | Clark |
| 4,053,813 | A | 10/1977 | Kornrumpf et al. |

(Continued)

FOREIGN PATENT DOCUMENTS

| | | |
|---|---|---|
| EP | 0326114 | 8/1989 |

(Continued)

OTHER PUBLICATIONS

Jordan et al., Resonant Fluorescent Lamp Converter Provides Efficient and Compact Solution, Mar. 1993, pp. 424-431.

(Continued)

*Primary Examiner*—Tuyet Vo
(74) *Attorney, Agent, or Firm*—Knobbe, Martens, Olson & Bear LLP

(57) ABSTRACT

A lamp inverter with continuous strike voltage facilitates faster striking of a fluorescent lamp, especially at cold temperatures. A frequency sweep generator sweeps the frequency of the lamp inverter to a striking frequency corresponding to a striking lamp voltage and then maintains the striking frequency until the lamp strikes.

20 Claims, 5 Drawing Sheets

U.S. PATENT DOCUMENTS

| | | | |
|---|---|---|---|
| 4,060,751 | A | 11/1977 | Anderson |
| 4,204,141 | A | 5/1980 | Nuver |
| 4,277,728 | A | 7/1981 | Stevens |
| 4,307,441 | A | 12/1981 | Bello |
| 4,353,009 | A | 10/1982 | Knoll |
| 4,388,562 | A | 6/1983 | Josephson |
| 4,392,087 | A | 7/1983 | Zansky |
| 4,437,042 | A | 3/1984 | Morais et al. |
| 4,441,054 | A | 4/1984 | Bay |
| 4,453,522 | A | 6/1984 | Salzgeber |
| 4,469,988 | A | 9/1984 | Cronin |
| 4,480,201 | A | 10/1984 | Jaeschke |
| 4,523,130 | A | 6/1985 | Pitel |
| 4,543,522 | A | 9/1985 | Moreau |
| 4,544,863 | A | 10/1985 | Hashimoto |
| 4,555,673 | A | 11/1985 | Huijsing et al. |
| 4,562,338 | A | 12/1985 | Okami |
| 4,567,379 | A | 1/1986 | Corey et al. |
| 4,572,992 | A | 2/1986 | Masaki |
| 4,574,222 | A | 3/1986 | Anderson |
| 4,585,974 | A | 4/1986 | Stupp et al. |
| 4,622,496 | A | 11/1986 | Dattilo et al. |
| 4,626,770 | A | 12/1986 | Price, Jr. |
| 4,630,005 | A | 12/1986 | Clegg et al. |
| 4,663,566 | A | 5/1987 | Nagano |
| 4,663,570 | A | 5/1987 | Luchaco et al. |
| 4,672,300 | A | 6/1987 | Harper |
| 4,675,574 | A | 6/1987 | Delflache |
| 4,682,080 | A | 7/1987 | Ogawa et al. |
| 4,686,615 | A | 8/1987 | Ferguson |
| 4,689,802 | A | 8/1987 | McCambridge |
| 4,698,554 | A | 10/1987 | Stupp et al. |
| 4,700,113 | A | 10/1987 | Stupp et al. |
| 4,717,863 | A | 1/1988 | Zeiler |
| 4,745,339 | A | 5/1988 | Izawa et al. |
| 4,761,722 | A | 8/1988 | Pruitt |
| 4,766,353 | A | 8/1988 | Burgess |
| 4,779,037 | A | 10/1988 | LoCascio |
| 4,780,696 | A | 10/1988 | Jirka |
| 4,792,747 | A | 12/1988 | Schroeder |
| 4,812,781 | A | 3/1989 | Regnier |
| 4,847,745 | A | 7/1989 | Shekhawat |
| 4,862,059 | A | 8/1989 | Tominaga et al. |
| 4,885,486 | A | 12/1989 | Shekhawat et al. |
| 4,893,069 | A | 1/1990 | Harada et al. |
| 4,902,942 | A | 2/1990 | El-Hamamsy et al. |
| 4,939,381 | A | 7/1990 | Shibata |
| 4,998,046 | A | 3/1991 | Lester |
| 5,023,519 | A | 6/1991 | Jensen |
| 5,030,887 | A | 7/1991 | Guisinger |
| 5,036,255 | A | 7/1991 | McKnight et al. |
| 5,049,790 | A | 9/1991 | Herfurth et al. |
| 5,057,808 | A | 10/1991 | Dhyanchand |
| 5,083,065 | A | 1/1992 | Sakata et al. |
| 5,089,748 | A | 2/1992 | Ihms |
| 5,105,127 | A | 4/1992 | Lavaud et al. |
| 5,130,565 | A | 7/1992 | Girmay |
| 5,130,635 | A | 7/1992 | Kase |
| 5,173,643 | A | 12/1992 | Sullivan et al. |
| 5,220,272 | A | 6/1993 | Nelson |
| 5,235,254 | A | 8/1993 | Ho |
| 5,289,051 | A | 2/1994 | Zitta |
| 5,317,401 | A | 5/1994 | Dupont et al. |
| 5,327,028 | A | 7/1994 | Yum et al. |
| 5,349,272 | A | 9/1994 | Rector |
| 5,406,305 | A | 4/1995 | Shimomura et al. |
| 5,410,221 | A | 4/1995 | Mattas et al. |
| 5,420,779 | A | 5/1995 | Payne |
| 5,430,641 | A | 7/1995 | Kates |
| 5,434,477 | A | 7/1995 | Crouse et al. |
| 5,440,208 | A | 8/1995 | Uskaly et al. |
| 5,463,287 | A | 10/1995 | Kurihara et al. |
| 5,471,130 | A | 11/1995 | Agiman |
| 5,475,284 | A | 12/1995 | Lester et al. |
| 5,475,285 | A | 12/1995 | Konopka |
| 5,479,337 | A | 12/1995 | Voigt |
| 5,485,057 | A | 1/1996 | Smallwood et al. |
| 5,485,059 | A | 1/1996 | Yamashita et al. |
| 5,485,487 | A | 1/1996 | Orbach et al. |
| 5,493,183 | A | 2/1996 | Kimball |
| 5,495,405 | A | 2/1996 | Fujimura et al. |
| 5,510,974 | A | 4/1996 | Gu et al. |
| 5,514,947 | A | 5/1996 | Berg |
| 5,519,289 | A | 5/1996 | Katyl et al. |
| 5,528,192 | A | 6/1996 | Agiman |
| 5,539,281 | A | 7/1996 | Shackle et al. |
| 5,548,189 | A | 8/1996 | Williams |
| 5,552,697 | A | 9/1996 | Chan |
| 5,557,249 | A | 9/1996 | Reynal |
| 5,563,473 | A | 10/1996 | Mattas et al. |
| 5,563,501 | A | 10/1996 | Chan |
| 5,574,335 | A | 11/1996 | Sun |
| 5,574,356 | A | 11/1996 | Parker |
| 5,608,312 | A | 3/1997 | Wallace |
| 5,612,594 | A | 3/1997 | Maheshwari |
| 5,612,595 | A | 3/1997 | Maheshwari |
| 5,615,093 | A | 3/1997 | Nalbant |
| 5,619,104 | A | 4/1997 | Eunghwa |
| 5,619,402 | A | 4/1997 | Liu |
| 5,621,281 | A | 4/1997 | Kawabata et al. |
| 5,629,588 | A | 5/1997 | Oda et al. |
| 5,635,799 | A | 6/1997 | Hesterman |
| 5,652,479 | A | 7/1997 | LoCascio et al. |
| 5,663,613 | A | 9/1997 | Yamashita et al. |
| 5,705,877 | A | 1/1998 | Shimada |
| 5,710,489 | A | 1/1998 | Nilssen |
| 5,712,533 | A | 1/1998 | Corti |
| 5,712,776 | A | 1/1998 | Palara et al. |
| 5,719,474 | A | 2/1998 | Vitello |
| 5,744,915 | A | 4/1998 | Nilssen |
| 5,748,460 | A | 5/1998 | Ishikawa |
| 5,751,115 | A | 5/1998 | Jayaraman et al. |
| 5,751,120 | A | 5/1998 | Zeitler et al. |
| 5,751,560 | A | 5/1998 | Yokoyama |
| 5,754,012 | A | 5/1998 | LoCascio |
| 5,754,013 | A | 5/1998 | Praiswater |
| 5,760,760 | A | 6/1998 | Helms |
| 5,770,925 | A | 6/1998 | Konopka et al. |
| 5,777,439 | A | 7/1998 | Hua |
| 5,786,801 | A | 7/1998 | Ichise |
| 5,796,213 | A | 8/1998 | Kawasaki |
| 5,808,422 | A | 9/1998 | Venkitasubrahmanian et al. |
| 5,818,172 | A | 10/1998 | Lee |
| 5,822,201 | A | 10/1998 | Kijima |
| 5,825,133 | A | 10/1998 | Conway |
| 5,828,156 | A | 10/1998 | Roberts |
| 5,844,540 | A | 12/1998 | Terasaki |
| 5,854,617 | A | 12/1998 | Lee et al. |
| 5,859,489 | A | 1/1999 | Shimada |
| 5,872,429 | A | 2/1999 | Xia et al. |
| 5,880,946 | A | 3/1999 | Biegel |
| 5,883,473 | A | 3/1999 | Li et al. |
| 5,886,477 | A | 3/1999 | Honbo et al. |
| 5,892,336 | A | 4/1999 | Lin et al. |
| 5,901,176 | A | 5/1999 | Lewison |
| 5,910,709 | A | 6/1999 | Stevanovic et al. |
| 5,910,713 | A | 6/1999 | Nishi et al. |
| 5,912,812 | A | 6/1999 | Moriarty, Jr. et al. |
| 5,914,842 | A | 6/1999 | Sievers |
| 5,923,129 | A | 7/1999 | Henry |
| 5,923,546 | A | 7/1999 | Shimada et al. |
| 5,925,988 | A | 7/1999 | Grave et al. |
| 5,930,121 | A | 7/1999 | Henry |
| 5,930,126 | A | 7/1999 | Griffin et al. |

5,936,360 A 8/1999 Kaneko
5,939,830 A 8/1999 Praiswater
6,002,210 A 12/1999 Nilssen
6,011,360 A 1/2000 Gradzki et al.
6,016,245 A 1/2000 Ross
6,020,688 A 2/2000 Moisin
6,028,400 A 2/2000 Pol et al.
6,037,720 A 3/2000 Wong et al.
6,038,149 A 3/2000 Hiraoka et al.
6,040,661 A 3/2000 Bogdan
6,040,662 A 3/2000 Asayama
6,043,609 A 3/2000 George et al.
6,049,177 A 4/2000 Felper
6,069,448 A 5/2000 Yeh
6,072,282 A 6/2000 Adamson
6,091,209 A 7/2000 Hilgers
6,104,146 A 8/2000 Chou et al.
6,108,215 A 8/2000 Kates et al.
6,111,370 A 8/2000 Parra
6,114,814 A 9/2000 Shannon et al.
6,121,733 A 9/2000 Nilssen
6,127,785 A 10/2000 Williams
6,127,786 A 10/2000 Moisin
6,137,240 A 10/2000 Bogdan
6,150,772 A 11/2000 Crane
6,157,143 A 12/2000 Bigio et al.
6,160,362 A 12/2000 Shone et al.
6,169,375 B1 1/2001 Moisin
6,172,468 B1 1/2001 Hollander
6,181,066 B1 1/2001 Adamson
6,181,083 B1 1/2001 Moisin
6,181,084 B1 1/2001 Lau
6,188,183 B1 2/2001 Greenwood et al.
6,188,553 B1 2/2001 Moisin
6,194,841 B1 2/2001 Takahasi et al.
6,198,234 B1 3/2001 Henry
6,198,236 B1 3/2001 O'Neill
6,211,625 B1 4/2001 Nilssen
6,215,256 B1 4/2001 Ju
6,218,788 B1 4/2001 Chen et al.
6,229,271 B1 5/2001 Liu
6,239,558 B1 5/2001 Fujimura et al.
6,252,355 B1 6/2001 Meldrum et al.
6,255,784 B1 7/2001 Weindorf
6,259,215 B1 7/2001 Roman
6,259,615 B1 7/2001 Lin
6,281,636 B1 8/2001 Okutsu et al.
6,281,638 B1 8/2001 Moisin
6,291,946 B1 9/2001 Hinman
6,294,883 B1 9/2001 Weindorf
6,307,765 B1 10/2001 Choi
6,310,444 B1 10/2001 Chang
6,313,586 B1 11/2001 Yamamoto et al.
6,316,881 B1 11/2001 Shannon et al.
6,316,887 B1 11/2001 Ribarich et al.
6,317,347 B1 11/2001 Weng
6,320,329 B1 11/2001 Wacyk
6,323,602 B1 11/2001 De Groot et al.
6,331,755 B1 12/2001 Ribarich et al.
6,340,870 B1 1/2002 Yamashita et al.
6,344,699 B1 2/2002 Rimmer
6,351,080 B1 2/2002 Birk et al.
6,356,035 B1 3/2002 Weng
6,359,393 B1 3/2002 Brown
6,362,577 B1 3/2002 Ito et al.
6,388,388 B1 5/2002 Weindorf et al.
6,396,217 B1 5/2002 Weindorf
6,396,722 B2 5/2002 Lin
6,417,631 B1 7/2002 Chen et al.
6,420,839 B1 7/2002 Chiang et al.
6,424,100 B1 7/2002 Kominami et al.
6,429,839 B1 8/2002 Sakamoto
6,433,492 B1 8/2002 Buonavita
6,441,943 B1 8/2002 Roberts et al.
6,445,141 B1 9/2002 Kastner et al.
6,452,344 B1 9/2002 MacAdam et al.
6,459,215 B1 10/2002 Nerone et al.
6,459,216 B1 10/2002 Tsai
6,469,922 B2 10/2002 Choi
6,472,827 B1 10/2002 Nilssen
6,472,876 B1 10/2002 Notohamiprodjo et al.
6,479,810 B1 11/2002 Weindorf
6,483,245 B1 11/2002 Weindorf
6,486,618 B1 11/2002 Li
6,494,587 B1 12/2002 Shaw et al.
6,495,972 B1 12/2002 Okamoto et al.
6,501,234 B2 12/2002 Lin et al.
6,507,286 B2 1/2003 Weindorf et al.
6,509,696 B2 1/2003 Bruning et al.
6,515,427 B2 2/2003 Oura et al.
6,515,881 B2 2/2003 Chou et al.
6,521,879 B1 2/2003 Rand et al.
6,522,558 B2 2/2003 Henry
6,531,831 B2 3/2003 Chou et al.
6,534,934 B1 3/2003 Lin et al.
6,559,606 B1 5/2003 Chou et al.
6,563,479 B2 5/2003 Weindorf et al.
6,570,344 B2 5/2003 Lin
6,570,347 B2 5/2003 Kastner
6,583,587 B2 6/2003 Ito et al.
6,593,703 B2 7/2003 Sun
6,628,093 B2 9/2003 Stevens
6,630,797 B2 10/2003 Qian et al.
6,633,138 B2 10/2003 Shannon et al.
6,642,674 B2 11/2003 Liao et al.
6,650,514 B2 11/2003 Schmitt
6,654,268 B2 11/2003 Choi
6,664,744 B2 12/2003 Dietz
6,680,834 B2 1/2004 Williams
6,703,998 B1 3/2004 Kabel et al.
6,707,264 B2 3/2004 Lin et al.
6,710,555 B1 3/2004 Terada et al.
6,864,867 B2 3/2004 Biebl
6,717,372 B2 4/2004 Lin et al.
6,717,375 B2 4/2004 Noguchi et al.
6,724,602 B2 4/2004 Giannopoulos
6,765,354 B2 7/2004 Klein
6,781,325 B2 8/2004 Lee
6,784,627 B2 8/2004 Suzuki et al.
6,803,901 B1 10/2004 Numao
6,804,129 B2 10/2004 Lin
6,809,718 B2 10/2004 Wei et al.
6,809,938 B2 10/2004 Lin et al.
6,816,142 B2 11/2004 Oda et al.
6,856,099 B2 2/2005 Chen et al.
6,856,519 B2 2/2005 Lin et al.
6,870,330 B2 3/2005 Choi
6,876,157 B2 4/2005 Henry
6,897,698 B1 5/2005 Gheorghiu et al.
6,900,599 B2 5/2005 Ribarich
6,900,600 B2 5/2005 Rust et al.
6,900,993 B2 5/2005 Lin et al.
6,922,023 B2 7/2005 Hsu et al.
6,930,893 B2 8/2005 Vinciarelli
6,936,975 B2 8/2005 Lin et al.
6,947,024 B2 9/2005 Lee et al.
6,967,449 B2 11/2005 Ishihara
6,967,657 B2 11/2005 Lowles et al.
6,969,958 B2 11/2005 Henry
6,979,959 B2 12/2005 Henry
7,026,860 B1 4/2006 Gheorghiu et al.
7,057,611 B2 6/2006 Lin et al.
7,075,245 B2 7/2006 Liu
7,095,392 B2 8/2006 Lin
7,120,035 B2 10/2006 Lin et al.
7,151,394 B2 12/2006 Gheorghiu et al.

| | | | |
|---|---|---|---|
| 7,183,724 | B2 | 2/2007 | Ball |
| 7,187,140 | B2 | 3/2007 | Ball |
| 7,190,123 | B2 | 3/2007 | Lee |
| 7,202,458 | B2 | 4/2007 | Park |
| 7,233,117 | B2 | 6/2007 | Wang et al. |
| 7,236,020 | B1 | 6/2007 | Virgil |
| 2001/0036096 | A1 | 11/2001 | Lin |
| 2002/0030451 | A1 | 3/2002 | Moisin |
| 2002/0097004 | A1 | 7/2002 | Chiang et al. |
| 2002/0114114 | A1 | 8/2002 | Schmitt |
| 2002/0118182 | A1 | 8/2002 | Weindorf |
| 2002/0130786 | A1 | 9/2002 | Weindorf |
| 2002/0135319 | A1 | 9/2002 | Bruning et al. |
| 2002/0140538 | A1 | 10/2002 | Yer |
| 2002/0145886 | A1 | 10/2002 | Stevens |
| 2002/0153852 | A1 | 10/2002 | Liao et al. |
| 2002/0171376 | A1 | 11/2002 | Rust et al. |
| 2002/0180380 | A1 | 12/2002 | Lin |
| 2002/0180572 | A1 | 12/2002 | Kakehashi et al. |
| 2002/0181260 | A1 | 12/2002 | Chou et al. |
| 2002/0195971 | A1 | 12/2002 | Qian et al. |
| 2003/0001524 | A1 | 1/2003 | Lin et al. |
| 2003/0020677 | A1 | 1/2003 | Nakano |
| 2003/0025462 | A1 | 2/2003 | Weindorf |
| 2003/0080695 | A1 | 5/2003 | Ohsawa |
| 2003/0090913 | A1 | 5/2003 | Che-Chen et al. |
| 2003/0117084 | A1 | 6/2003 | Stack |
| 2003/0141829 | A1 | 7/2003 | Yu |
| 2003/0161164 | A1 | 8/2003 | Shannon et al. |
| 2003/0227435 | A1 | 12/2003 | Hsieh |
| 2004/0000879 | A1 | 1/2004 | Lee |
| 2004/0012556 | A1 | 1/2004 | Yong et al. |
| 2004/0017348 | A1 | 1/2004 | Numao |
| 2004/0032223 | A1 | 2/2004 | Henry |
| 2004/0051473 | A1 | 3/2004 | Jales et al. |
| 2004/0145558 | A1 | 7/2004 | Cheng |
| 2004/0155596 | A1 | 8/2004 | Ushijima |
| 2004/0155853 | A1 | 8/2004 | Lin |
| 2004/0189217 | A1 | 9/2004 | Ishihara et al. |
| 2004/0257003 | A1 | 12/2004 | Hsieh et al. |
| 2004/0263092 | A1 | 12/2004 | Liu |
| 2005/0062436 | A1 | 3/2005 | Jin |
| 2005/0093471 | A1 | 5/2005 | Jin |
| 2005/0093472 | A1 | 5/2005 | Jin |
| 2005/0093482 | A1 | 5/2005 | Ball |
| 2005/0093483 | A1 | 5/2005 | Ball |
| 2005/0093484 | A1 | 5/2005 | Ball |
| 2005/0094372 | A1 | 5/2005 | Jin |
| 2005/0099143 | A1 | 5/2005 | Kohno |
| 2005/0156536 | A1 | 7/2005 | Ball |
| 2005/0156539 | A1 | 7/2005 | Ball |
| 2005/0156540 | A1 | 7/2005 | Ball |
| 2005/0162098 | A1 | 7/2005 | Ball |
| 2005/0218825 | A1 | 10/2005 | Chiou |
| 2005/0225261 | A1 | 10/2005 | Jin |
| 2006/0022612 | A1 | 2/2006 | Henry |
| 2006/0049959 | A1 | 3/2006 | Sanchez |

FOREIGN PATENT DOCUMENTS

| | | |
|---|---|---|
| EP | 0587923 | 3/1994 |
| EP | 0597661 | 5/1994 |
| EP | 0647021 | 9/1994 |
| JP | 06168791 | 6/1994 |
| JP | 8-204488 | 8/1996 |
| KR | 10-2003-0075461 | 10/2003 |
| TW | 554643 | 9/2003 |
| TW | 8-204488 | 12/2003 |
| TW | 200501829 | 1/2005 |
| WO | WO 94/15444 | 7/1994 |
| WO | WO 98/09369 | 3/1998 |
| WO | WO 9941953 | 8/1999 |
| WO | WO 0237904 | 5/2002 |

OTHER PUBLICATIONS

Unitrode Datasheet, Resonant Fluorescent Lamp Driver, UC 1871/2871/3871, May 1993, pp. 1-6.

Unitrode Product & Applications Handbook 1993-94, U-141, Jun. 1993, pp. i-ii; 9-471-9-478.

Williams, Jim, Techniques for 92% Efficient LCD Illumination, Linear Technology Application Note 55, Aug. 1993.

Unitrode Datasheet, Resonant Fluorescent Lamp Driver, UC 1871/2871/3871, Oct. 1994, pp. 1-6.

O'Connor, J., Dimmable Cold-Cathode Fluorescent Lamp Ballast Design Using the UC3871, Application Note U-148, pp. 1-15,1995.

Goodenough, Frank, DC-to-AC Inverter Ups CCFL Lumens Per Watt, Electronic Design, Jul. 10, 1995, pp. 143-148.

Coles, Single Stage CCFL Backlight Resonant Inverter using PWM Dimming Methods, 1998, pp. 35-38.

Micro Linear, ML4878 Single-Stage CCFL Backlight Resonant Inverter, Application Note 68, May 1998, pp. 1-12.

Plaintiff O2 Micro International Limited's Preliminary Invalidity Contentions re Third-Party Defendant Microsemi Corporation Patents, dated Sep. 14, 2007.

Third-Party Defendant Microsemi Corporation's Brief in Support of its Claim Construction for U.S. Patent Nos. 5,930,121 and 6,198,234, dated Oct. 19, 2007.

Declaration of Irfan A. Lateef in Support of Third-Party Defendant Microsemi Corporation's Brief in Support of its Claim Construction for U.S. Patent Nos. 5,930,121 and 6,198,234, dated Oct. 19, 2007.

Plaintiff O2 Micro International Limited's Brief in Response to Third-Party Defendant Microsemi Corporation's Brief Re Claim Construction for U.S. Patent Nos. 5,930,121 and 6,198,234, dated Oct. 26, 2007.

Declaration of Henry C. Su in Support of Plaintiff 02 Micro International Limited's Brief in Response to Third-Party Defendant Microsemi Corporation's Brief Re Claim Construction for U.S. Patent Nos. 5,930,121 and 6,198,234, dated Oct. 26, 2007.

Defendant/Counterclaimant Monolithic Power Systems, Inc.'s Notice of Motion and Motion for Summary Judgment of Invalidity of Asserted Claims of U. S. Patent No. 6,198,234, dated Nov. 14, 2005.

Defendant/Counterclaimant Monolithic Power Systems, Inc.'s Memorandum of Points and Authorities in Support of Motion for Summary Judgment of Invalidity of Asserted Claims of U. S. Patent No. 6,198,234, dated Nov. 14, 2005.

Declaration of Robert Mammano filed by Defendant/Counterclaimant Monolithic Power Systems, Inc.'s In Support of Its Motion for Summary Judgment of Invalidity of Asserted Claims of U. S. Patent No. 6,198,234, dated Nov. 14, 2005.

Declaration of John A. O'Connor filed by Defendant/Counterclaimant Monolithic Power Systems, Inc.'s In Support of Its Motion for Summary Judgment of Invalidity of Asserted Claims of U. S. Patent No. 6,198,234, dated Nov. 14, 2005.

Declaration of Defendant/Counterclaimant Monolithic Power Systems, Inc.'s Expert Witness, Dr. Douglas C. Hopkins, In Support of Its Motion for Summary Judgment of Invalidity of Asserted Claims of U.S. Patent No. 6,198,234, dated Nov. 14, 2005.

Declaration of Doyle Slack filed by Defendant/Counterclaimant Monolithic Power Systems, Inc.'s In Support of its Motion for Summary Judgment of Invalidity of Asserted Claims of U.S. Patent No. 6,198,234, dated Nov. 14, 2005.

Declaration of Dean G. Dunlavey filed by Defendant/Counterclaimant Monolithic Power Systems, Inc.'s In Support of Its Motion for Summary Judgment of Invalidity of Asserted Claims of U.S. Patent No. 6,198,234, dated Nov. 14, 2005.

Declaration of Charles Coles filed by Defendant/Counterclaimant Monolithic Power Systems, Inc.'s In Support of Its Motion for Summary Judgment of Invalidity of Asserted Claims of U.S. Patent No. 6,198,234, dated Nov. 14, 2005.

Plaintiff Microsemi Corporation's Opposition to Defendant/Counterclaimant Monolithic Power Systems, Inc.'s Motion for Summary Judgment of Invalidity of Asserted Claims of U. S. Patent No. 6,198,234, dated Feb. 13, 2006.

Plaintiff Microsemi Corporation's Statement of Genuine Issues in Opposition to Defendant/Counterclaimant Monolithic Power Systems, Inc.'s Motion for Summary Judgment of Invalidity of Asserted Claims of U.S. Patent No. 6,198,234, dated Feb. 13, 2006.

Defendant/Counterclaimant Monolithic Power Systems, Inc.'s Reply Brief in Support of Motion for Summary Judgment of Invalidity of Asserted Claims of U. S. Patent No. 6,198,234, dated Mar. 13, 2006.

Supplemental Declaration of Dean G. Dunlavey filed by Defendant/Counterclaimant Monolithic Power Systems, Inc.'s In Support of Its Motion for Summary Judgment of Invalidity of Asserted Claims of U. S. Patent No. 6,198,234, dated Mar. 13, 2006.

Defendant/Counterclaimant Monolithic Power Systems, Inc.'s Notice of Motion and Motion for Summary Judgment of Invalidity of Asserted Claims of U. S. Patent No. 5,615,093, dated Nov. 14, 2005.

Defendant/Counterclaimant Monolithic Power Systems, Inc.'s Memorandum of Points and Authorities in Support of Motion for Summary Judgment of Invalidity of Asserted Claims of U. S. Patent No. 5,615,093, dated Nov. 14, 2005.

Plaintiff Microsemi Corporation's Opposition to Defendant/Counterclaimant Monolithic Power Systems, Inc.'s Motion for Summary Judgment of Invalidity of Asserted Claims of U. S. Patent No. 5,615,093, dated Feb. 13, 2006.

Plaintiff Microsemi Corporation's Statement of Genuine Issues in Opposition to Defendant/Counterclaimant Monolithic Power Systems, Inc.'s Motion for Summary Judgment of Invalidity of Asserted Claims of U. S. Patent No. 5,615,093, dated Feb. 13, 2006.

Defendant/Counterclaimant Monolithic Power Systems, Inc.'s Reply Brief in Support of Motion for Summary Judgment of Invalidity of Asserted Claims of U. S. Patent No. 5,615,093, dated Mar. 13, 2006.

Williams, B.W.; "Power Electronics Devices, Drivers, Applications and Passive Components"; Second Edition, McGraw-Hill, 1992; Chapter 10, pp. 218-249.

Bradley, D.A., "Power Electronics" 2nd Edition; Chapman & Hall, 1995; Chapter 1, pp. 1-38.

Dubey, G. K., "Thyristorised Power Controllers"; Halsted Press, 1986; pp. 74-77.

IEEE Publication, "Dual Switched Mode Power Converter": Pallab Midya & Fred H. Schlereth; p. 155 1989.

IEEE Publication, "High Frequency Resonant Inverter For Group Dimming Control of Fluorescent Lamp Lighting Systems", K.H. Jee, et al., 1989 149-154.

Int. J. Electronics, "New soft-switching inverter for high efficiency electronic ballast with simple structure" E.C. Nho, et al., 1991, vol. 71, No. 3, 529-541.

Nguyen, Don J., "Optimizing Mobile Power Delivery". Presented at Intel Developers Forum, Fall 2001, p. 4.

Tannas, Lawrence, "Flat Panel Displays and CRTs". © 1985 Van Nostrand Reinhold Company Inc., pp. 96-99.

PCT International Search Report and Written Opinion mailed Apr. 8, 2008, Appl. No. PCT/US2007/072862 in 12 pages.

APPARATUS AND METHOD FOR STRIKING A FLUORESCENT LAMP

RELATED APPLICATIONS

This application is a continuation of and claims benefit of priority under 35 U.S.C. § 120 from U.S. patent application Ser. No. 11/255,563, filed on Oct. 21, 2005 now U.S. Pat. No. 7,279,852, which is a continuation of U.S. patent application Ser. No. 10/453,760, filed on Jun. 3, 2003 now U.S. Pat. No. 6,979,959, which claims the benefit of priority under 35 U.S.C. § 119(e) of U.S. Provisional Application No. 60/433,557 entitled "Apparatus and Method for Striking a Fluorescent Lamp," filed on Dec. 13, 2002, the entirety of each of which is hereby incorporated herein by reference.

BACKGROUND OF THE INVENTION

1. Field of the Invention

The present invention relates to a power conversion circuit for driving fluorescent lamps, such as, for example, cold cathode fluorescent lamps (CCFLs), and more particularly relates to starting a fluorescent lamp with improved efficiency.

2. Description of the Related Art

Fluorescent lamps are used in a number of applications where light is required but the power required to generate the light is limited. One particular type of fluorescent lamp is a cold cathode fluorescent lamp (CCFL). CCFLs are used for back lighting or edge lighting of liquid crystal displays (LCDs), which are typically used in notebook computers, web browsers, automotive and industrial instrumentations, and entertainment systems. Such fluorescent lamps require a high starting voltage (on the order of 700-1,600 volts) for a short period of time to ionize the gas contained within the lamp tubes for ignition. After the gas in the CCFL is ionized and the CCFL is fired, less voltage is needed to keep the CCFL on.

A CCFL tube typically contains a gas, such as Argon, Xenon, or the like, along with a small amount of Mercury. After an initial ignition stage and the formation of plasma, current flows through the tube, which results in the generation of ultraviolet light. The ultraviolet light in turn strikes a phosphorescent material coated in the inner wall of the tube, resulting in visible light.

A power conversion circuit is generally used for driving the CCFL. The power conversion circuit accepts a direct current (DC) input voltage and provides an alternating current (AC) output voltage to the CCFL. The brightness (or the light intensity) of the CCFL is controlled by controlling the current (i.e., the lamp current) through the CCFL. For example, the lamp current can be amplitude modulated or pulse width modulated to control the brightness of the CCFL.

One type of power conversion circuits includes a resonant circuit. The power conversion circuit includes switching transistors in a half bridge topology or a full bridge topology using power metal-oxide-semiconductor-field-effect-transistors (MOSFETs) to provide the DC to AC conversion. Maximum power is provided at the output of the power conversion circuit by switching the MOSFETs with driving signals at a resonant frequency. To control the output voltage as well as the current through the lamp, the power conversion circuit can change the frequency of the driving signals either towards the resonant frequency or away from the resonant frequency.

SUMMARY OF THE INVENTION

One aspect of the present invention is a power conversion circuit (or a lamp inverter) with a strike circuit to apply a continuous strike voltage at an output to a fluorescent lamp for efficient ignition of the fluorescent lamp. The strike circuit helps the fluorescent lamp to start (or to strike) in a relatively short time, especially at relatively cold temperatures. The strike circuit maintains the continuous strike voltage at a relatively high level when the power conversion circuit is in an ignition mode (or a striking mode). After the fluorescent lamp strikes, the power conversion circuit enters a normal operating mode and a relatively lower level normal operating voltage is provided at the output to the fluorescent lamp.

The power conversion circuit can employ half-bridge, full-bridge or direct drive inverter topologies. In one embodiment, the power conversion circuit includes a pulse width modulation (PWM) controller, a primary network, a secondary network, a current feedback circuit, a voltage feedback circuit and a strike circuit. The PWM controller provides driving signals to the primary network to produce a substantially AC output voltage at the secondary network. The secondary network is coupled to the fluorescent lamp. The voltage feedback circuit is coupled to the secondary network to monitor the voltage provided to the fluorescent lamp, and the current feedback circuit is coupled to the fluorescent lamp to monitor the current flowing through the fluorescent lamp. The respective outputs of the voltage feedback circuit and the current feedback circuit are provided to the strike circuit. The strike circuit controls the frequency of the driving signals provided to the primary network.

In one embodiment the power conversion circuit includes a direct drive inverter that generates a substantially AC output signal to drive the fluorescent lamp. The direct drive inverter includes a direct drive controller, a direct drive network and a secondary network. The direct drive controller provides driving signals to the direct drive network to produce a substantially AC output voltage at the secondary network. The secondary network is coupled to the fluorescent lamp, such as a CCFL, and the substantially AC output voltage results in a substantially AC current (i.e., a lamp current) which flows through the CCFL to illuminate the CCFL. Initially, the substantially AC output voltage is maintained at a relatively constant high level to ignite (or to start the lamp current flowing through) the CCFL. After the CCFL ignites, the level of the substantially AC output voltage is lower to maintain a flow of lamp current through the CCFL.

In one embodiment, the level of the substantially AC output voltage is controlled by varying the frequency of the driving signals. In one embodiment, power conversion circuit sweeps the frequency of the driving signals from an initial frequency to a striking frequency (e.g., one to five times the normal operating frequency) during an ignition process. For example, in one embodiment, the power conversion circuit sweeps the frequency of the driving signals from a relatively low normal operating frequency to a relatively high striking frequency (e.g., one to five times the normal operating frequency) during an ignition process. Inductance of the secondary network and capacitance of the CCFL form a resonant circuit. The capacitance of the CCFL changes from a relatively low value when the CCFL is not lighted to a higher value after ignition. Thus, the resonant circuit has a relatively high unloaded resonant frequency (i.e., a relatively high resonant frequency when the CCFL is not ignited). The rising frequency of the driving signals causes the level of the substantially AC output voltage to rise as the frequency of the driving signals approaches the unloaded resonant frequency.

Alternatively, in one embodiment, the power conversion circuit sweeps the frequency of the driving signals down from an initial frequency that is higher than the striking frequency to the relatively high striking frequency during an ignition process.

In one embodiment, the strike circuit (or a frequency sweep generator circuit) manages the frequency (or timing) of the driving signals in the ignition mode. The strike circuit monitors the status of the CCFL and the substantially AC output voltage to control the frequency of the driving signals. For example, the strike circuit checks for ignition of the CCFL as part of a start-up sequence. If the CCFL is not ignited, the strike circuit can sweep the frequency of the driving signals up or down from an initial frequency to a relatively high striking frequency. The relatively high striking frequency corresponds to the power conversion circuit producing a substantially AC output voltage (i.e., a striking voltage) with a level sufficient to start an unlighted CCFL. After the lamp strikes, the strike circuit shifts the frequency to a normal operating frequency that is relatively lower than the striking frequency.

If the strike circuit detects ignition of the CCFL during the frequency sweep, the strike circuit stops the frequency sweep and resets the frequency of the driving signals to the normal operating frequency for normal operations. If the striking frequency is reached before the CCFL ignites during the frequency sweep, the strike circuit locks (or stops sweeping) the frequency of the driving signals. The frequency of the driving signals stays at the striking frequency to continuously apply the striking voltage to the unlighted CCFL. The strike circuit continues to monitor the status of the CCFL and reduces the frequency of the driving signals to the normal operating frequency once the CCFL ignites. The continuous application of the striking voltage advantageously facilitates faster starting of the CCFL.

In one embodiment, the strike circuit outputs a fault signal if the strike circuit fails to detect ignition of the CCFL after a predetermined duration of applying the striking voltage to the CCFL. The fault signal can indicate a faulty or missing CCFL. The fault signal can be provided to the direct drive controller to effectively shut down the power conversion circuit. In one embodiment, the strike circuit can be integrated with the direct drive controller.

In one embodiment, the strike circuit monitors the status of the CCFL by monitoring the lamp current. For example, the absence of lamp current indicates that the CCFL is not ignited. The presence of lamp current with a predefined minimum amplitude and for a predefined minimum duration indicates reliable ignition of the CCFL. The strike circuit can monitor the level of the substantially AC output voltage using a capacitive divider placed across (or in parallel) with the CCFL. The capacitive divider produces a scaled version of the relatively high voltage levels of the substantially AC output voltage for efficient processing by the strike circuit.

DETAILED DESCRIPTION OF THE PREFERRED EMBODIMENTS

Figure 1:
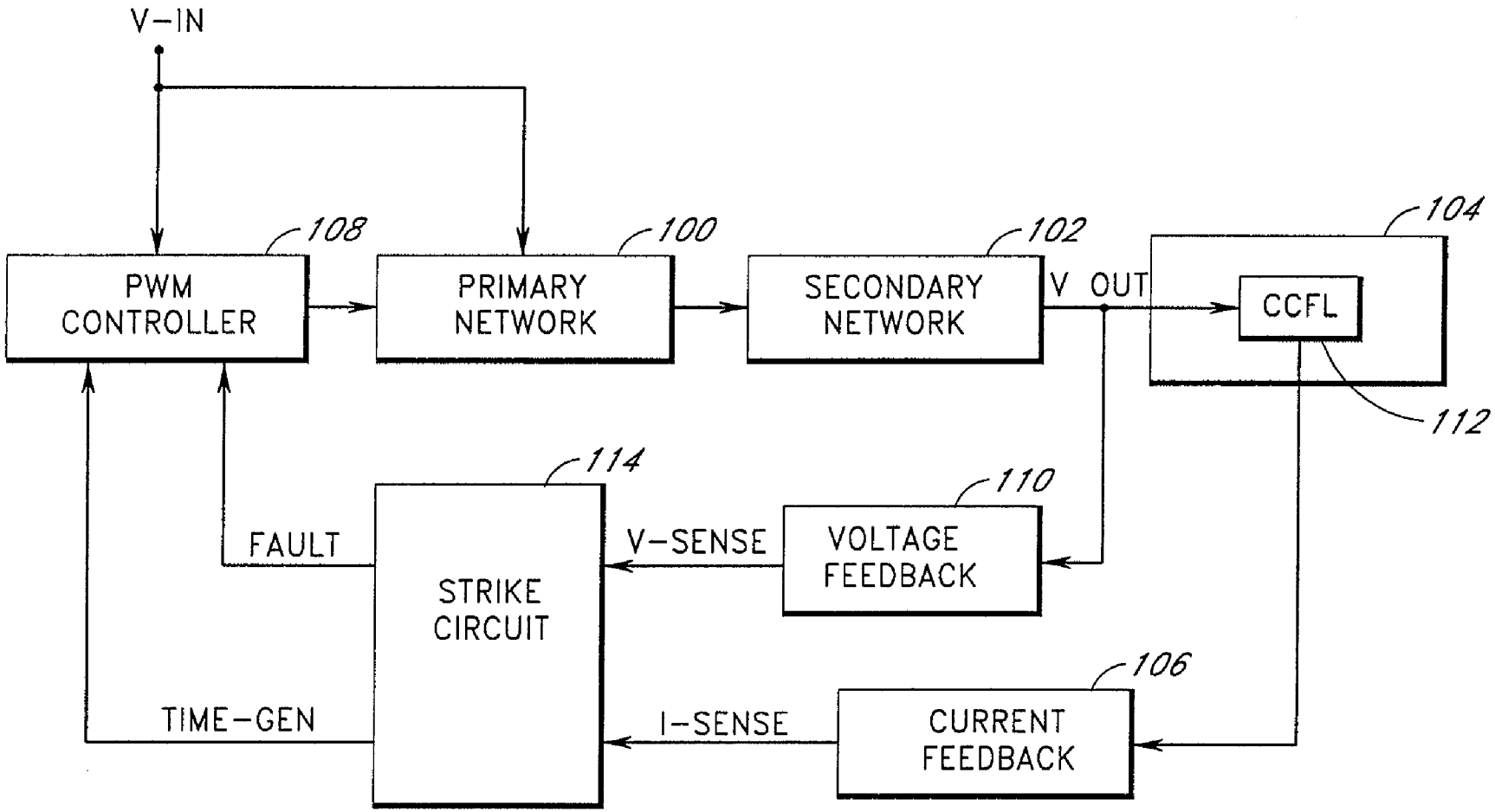
FIG. 1 is a block diagram of a power conversion circuit according to one embodiment of the present invention.

Embodiments of the present invention will be described hereinafter with reference to the drawings. FIG. 1 is a block diagram of a power conversion circuit according to one embodiment of the present invention. The power conversion circuit (or the lamp inverter) converts a substantially DC input voltage (V-IN) into a substantially AC output voltage (V-OUT) to drive a CCFL 112. An AC current (or a lamp current) flows through the CCFL 112 to provide illumination in an electronic device 104, such as, for example, a flat panel display, a personal digital assistant, a palm top computer, a scanner, a facsimile machine, a copier, or the like.

The power conversion circuit includes a PWM controller 108, a primary network 100, a secondary network 102, a current feedback circuit 106, a voltage feedback circuit 110 and a strike circuit 114. The input voltage (or the supply voltage) is provided to the primary network 100 and the PWM controller 108. The primary network 100 is controlled by driving signals provided by the PWM controller 108. The secondary network 102 is coupled to the primary network 100 and produces the output voltage to drive the CCFL 112. The current feedback circuit 106 is coupled to the CCFL 112 and generates a current feedback signal (I-SENSE) indicative of the lamp current level for the strike circuit 114. The voltage feedback circuit 110 is coupled to the output of the secondary network 102 and generates a voltage feedback signal (V-SENSE) indicative of the output voltage level for the strike circuit 114. The strike circuit 114 provides a fault output (FAULT) and a timing output (TIME-GEN) to the PWM controller 108.

The strike circuit (or the frequency sweep generator) 114 improves ignition time of the CCFL 112 and reliability of the power conversion circuit. The CCFL 112 typically requires a relatively high voltage to ignite and can operate at a relatively lower voltage after ignition. The output of the power conversion circuit and the CCFL 112 form a resonant circuit. The amplitude of the output voltage can be controlled by changing the frequency of the output voltage either towards the resonant frequency or away from the resonant frequency. The frequency of the output voltage follows the frequency of the driving signals provided by the PWM controller 108 to the primary network 100. Thus, the amplitude of the output voltage to drive the CCFL 112 can be varied by varying the frequency of the driving signals.

In one embodiment of an ignition process, the strike circuit 114 provides the timing output to the PWM controller 108 to sweep the frequency of the driving signals from an initial frequency to a striking frequency corresponding to a predetermined output voltage (or a striking voltage) sufficient to ignite an unlighted CCFL. In one embodiment, the initial frequency is lower than the striking frequency. In one embodiment, the initial frequency is higher than the striking frequency. In one embodiment, the initial frequency corresponds to the normal operating frequency. The strike circuit 114 stops sweeping and stays at the striking frequency to continuously apply the striking voltage to an unlighted CCFL until the CCFL ignites.

For example, the strike circuit 114 can monitor the status of the CCFL 112 using the current feedback signal (or the sensed current). If the CCFL 112 is unlighted (e.g., the sensed current is below a predefined threshold), the strike circuit 114 begins sweeping the frequency of the driving signals from a relatively low normal operating frequency to an increasingly higher frequency while monitoring the voltage feedback signal (or the sensed voltage). When the sensed voltage reaches a predefined level corresponding to the striking voltage, the strike circuit 114 stops sweeping and locks the frequency of the driving signals to continuously apply the striking voltage to the unlighted CCFL 112. Continuous application of the striking voltage to the CCFL 112 facilitates faster striking of the CCFL 112, especially at cold temperatures.

The strike circuit 114 continuously monitors the status of the CCFL 112 and terminates the ignition process once the CCFL 112 strikes. For example, the strike circuit 114 resets the frequency of the driving signals to the normal operating frequency once the sensed current is above the predefined threshold for a sufficient period of time indicating that the CCFL 112 has reliably started.

In one embodiment, if the CCFL 112 does not start after a predetermined period of time (or a time-out period) during continuous application of the striking voltage to the CCFL 112, the strike circuit 114 provides the fault output to the PWM controller 108 to shut down the power conversion circuit. The fault output may indicate that the CCFL 112 is defective or missing. Shutting down the power conversion circuit avoids overheating the power conversion circuit resulting from prolong high frequency operation.

The timing output provided by the strike circuit 114 can be a control signal to control a frequency generator in the PWM controller 108. Alternatively, the timing output can be a ramp signal provided to a PWM circuit in the PWM controller 108. The strike circuit 114 varies the frequency of the ramp signal to vary the frequency of the driving signals outputted by the PWM controller 108.

Figure 2:
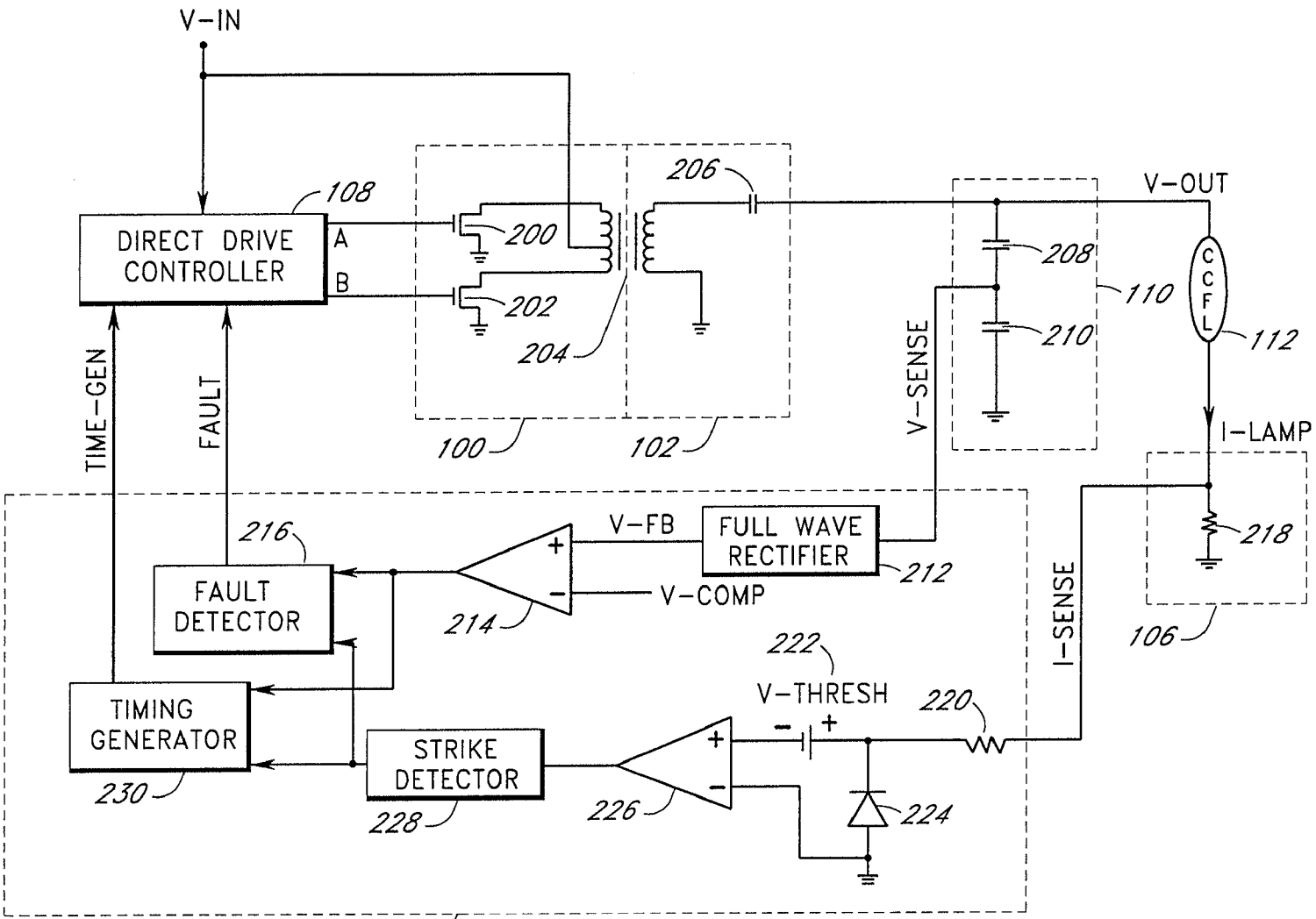
FIG. 2 is a circuit diagram of one embodiment of the power conversion circuit shown in FIG. 1.

FIG. 2 a circuit diagram of one embodiment of the power conversion circuit shown in FIG. 1. The primary network 100 is a direct drive network 232, and the PWM controller 108 is a direct drive controller 234. The direct drive network 232 is controlled by two driving signals (A and B) provided by the direct drive controller 234 and works with the secondary network 102 to provide the output voltage (V-OUT) to the CCFL 112. The current feedback circuit 106 is coupled in series with the CCFL 112 to provide the sensed current (I-SENSE) indicative of the lamp current (I-LAMP) to the strike circuit 114. The voltage feedback circuit 110 is coupled in parallel with the CCFL 112 to provide the sensed voltage (V-SENSE) indicative of the output voltage to the strike circuit 114.

In one embodiment, the direct drive network 232 includes switching transistors 200, 202 and a primary winding of a transformer 204. In one configuration, the input voltage is provided to a center-tap of the primary winding of the transformer 204. The switching transistors 200, 202 are coupled to respective opposite terminals of the primary winding of the transformer 204 to alternately switch the respective terminals to ground. For example, the first switching transistor 200 is a n-type field-effect-transistor (N-FET) with a drain terminal coupled to a first terminal of the primary winding of the transformer 204 and a source terminal coupled to ground. The second switching transistor 202 is a N-FET with a drain terminal coupled to a second terminal of the primary winding of the transformer 204 and a source terminal coupled to ground. The switching transistors 200, 202 are controlled by the respective driving signals (A, B) which are coupled to gate terminals of the respective switching transistors 200, 202.

An AC signal (or a transformer drive signal) on the primary winding results from alternating conduction by the switching transistors 200, 202 which is controlled by the direct drive controller 234. Other configurations (e.g., half-bridge or full-bridge inverter topologies) to couple the input voltage and switching transistors to the transformer are possible to produce the transformer drive signal. The AC signal is magnetically coupled to a secondary winding of the transformer 204 in the secondary network 102, which also includes a DC blocking capacitor 206. A first terminal of the secondary winding of the transformer 204 is coupled to ground while a second terminal of the secondary winding is coupled to a first terminal of the capacitor 206. The second terminal of the capacitor 206 is coupled to a first terminal of the CCFL 112.

In one embodiment, the voltage feedback circuit 110 is a capacitor divider coupled between the first terminal of the CCFL 112 and ground. For example, a first capacitor 208 is coupled between the first terminal of the CCFL 112 and a first node. A second capacitor 210 is coupled between the first node and ground. The voltage across the second capacitor 210 is proportional to the output voltage and is provided as the sensed voltage (V-SENSE) to the strike circuit 114 to indicate the output voltage level.

A second terminal of the CCFL 112 is coupled to the current feedback circuit 106. In one embodiment, the feedback circuit 106 includes a sensing resistor 218 coupled between the second terminal of the CCFL 112 and ground. The lamp current substantially flows through the sensing resistor 218, and the voltage across the sensing resistor 218 is provided as the sensed current (I-SENSE) to the strike circuit 114 to indicate the lamp current level.

Alternately, the current feedback circuit 106 can be coupled to the secondary network 102 to generate a current feedback signal indicative of the operating conditions of the CCFL 112. For example, the sensing resistor 218 can be inserted between the first terminal of the secondary winding and ground to generate a feedback signal indicative of the lamp current level.

The output voltage (or the lamp voltage) to start an unlighted CCFL (i.e., the striking lamp voltage) needs to be higher than the lamp voltage to keep a lighted CCFL running (i.e., the running lamp voltage). One method of providing the higher striking lamp voltage is to increase the frequency of the transformer drive signal (or the driving signals) from a low running frequency to a higher striking frequency during ignition of the CCFL 112.

Because the drive circuitry connected to the primary winding of the transformer 204 consists solely of the two switching transistors 200, 202 and does not include any resonant components, the primary winding can be readily driven at a wide range of frequencies. The transformer 204 and the CCFL 112 form a resonant circuit which has a higher resonant frequency when the CCFL 112 is not ignited. By increasing the frequency of the transformer drive signal closer to the higher resonant frequency, the corresponding lamp voltage increases towards a striking potential.

One embodiment of the present invention uses the strike circuit 114 to sweep the frequency of the transformer drive signal to a striking frequency corresponding to the striking lamp voltage and then maintains the striking frequency to continuously provide the striking lamp voltage until the CCFL 112 strikes. Continuous application of the striking lamp voltage facilitates faster striking of the CCFL 112, especially at cold temperatures.

In one embodiment, the strike circuit 114 includes a full-wave rectifier 212, a first comparator 214, a current limiting resistor 220, a clamping diode 224, a voltage reference 222, a second comparator 226, a strike detector circuit 228, a fault detector circuit 216 and a timing generator circuit 230. The fault detector circuit 216 outputs a fault signal (FAULT) to the direct drive controller 234 to shut down the power conversion circuit when fault conditions are present. The timing generator circuit 230 outputs a timing signal (TIME-GEN) to the direct drive controller 234 to control the frequency of the driving signals.

The strike circuit 114 monitors the output voltage (or the lamp voltage) and the lamp current to control striking of the CCFL 112. The output voltage is monitored to determine when the output voltage level reaches a striking potential. For example, the sensed voltage indicative of the output voltage is provided to the full-wave rectifier 212. The full-wave rectifier 212 outputs a feedback voltage (V-FB) which indicates the level of the output voltage to the first comparator 214. In addition to the output from the full-wave rectifier 212, the first comparator 214 receives a comparison voltage (V-COMP). The first comparator 214 outputs a first signal when the sensed voltage is greater than the comparison voltage indicating that the output voltage has reached a striking potential. The first signal is provided to both the fault detector circuit 216 and the timing generator circuit 230.

The lamp current is monitored to determine when the CCFL 112 ignites. For example, the sensed current indicative of the lamp current is provided to a first terminal of the current limiting resistor 220. The value of the current limiting resistor 220 is relatively large (e.g., 200 kilo-Ohms) to ensure accurate readings of the lamp current. The clamping diode 224 is coupled between the second terminal of the current limiting resistor 220 and ground to limit the levels of the negative lamp current cycles to the diode threshold. The reference voltage is coupled between the second terminal of the current limiting resistor 220 and a positive input terminal of the second comparator 226. A negative input terminal of the second comparator 226 is coupled to ground.

The second comparator 226 outputs a pulse when the level of a lamp current cycle exceeds the reference voltage. The output of the second comparator 226 is provided to the strike detector circuit 228. In one embodiment, the strike detector circuit 228 counts the pulses and outputs a second signal indicating that the CCFL 112 is lighted when the number of consecutive pulses exceed a predetermined number. The second signal is provided to both the fault detector circuit 216 and the timing generator circuit 230.

The timing generator circuit 230 generates the timing signal to control the frequency of the driving signals based on the first signal indicating when the output voltage reaches the striking potential and the second signal indicating when the CCFL 112 ignites. For example, when the second signal indicates that the CCFL 112 has not ignited during a striking process, the timing generator 230 causes the frequency of the driving signals to increase gradually (or to sweep from a relatively low frequency to higher frequencies) via the timing signal to the direct drive controller 234 until the first signal indicates that the output voltage has reached a striking potential. When the output voltage reaches the striking potential and the CCFL 112 is still unlighted, the timing generator circuit 230 stops sweeping and holds the frequency of the driving signals to continuously apply the striking potential to the CCFL 112 until the second signal indicates that the CCFL 112 has ignited. Once the CCFL 112 ignites, the striking process ends and the timing generator 230 resets the frequency of the driving signals to the normal operating frequency.

In one embodiment, the timing signal controls the frequency of an oscillator in the direct drive controller 234. In an alternate embodiment, the timing generator 230 includes an oscillator, and the timing signal is a ramp signal provided to a PWM circuit in the direct drive controller 234. The frequency of the ramp signal determines the frequency of the driving signals provided to the direct drive network 232. The circuits in the strike circuit 114 can be integrated with the direct drive controller 234.

The fault detector circuit 216 generates the fault signal to override other control signals and to shut down the power conversion circuit when fault conditions occur during the striking process. For example, when the CCFL 112 fails to strike after a predetermined period (a time-out period) of applying the striking potential to the CCFL 112, the fault detector circuit outputs the fault signal to the direct drive controller 234 to shut down the power conversion circuit. In one embodiment, the fault detector circuit 216 starts a timer when the first signal from the first comparator 214 indicates the output voltage has reached a striking potential. The timer expires after a predetermined time. If the second signal from the strike detector circuit 228 did not indicate the CCFL 112 has ignited before the timer expires, the fault detector circuit 216 outputs the fault signal. The fault signal may indicate that the CCFL 112 is missing or defective.

Figure 3:
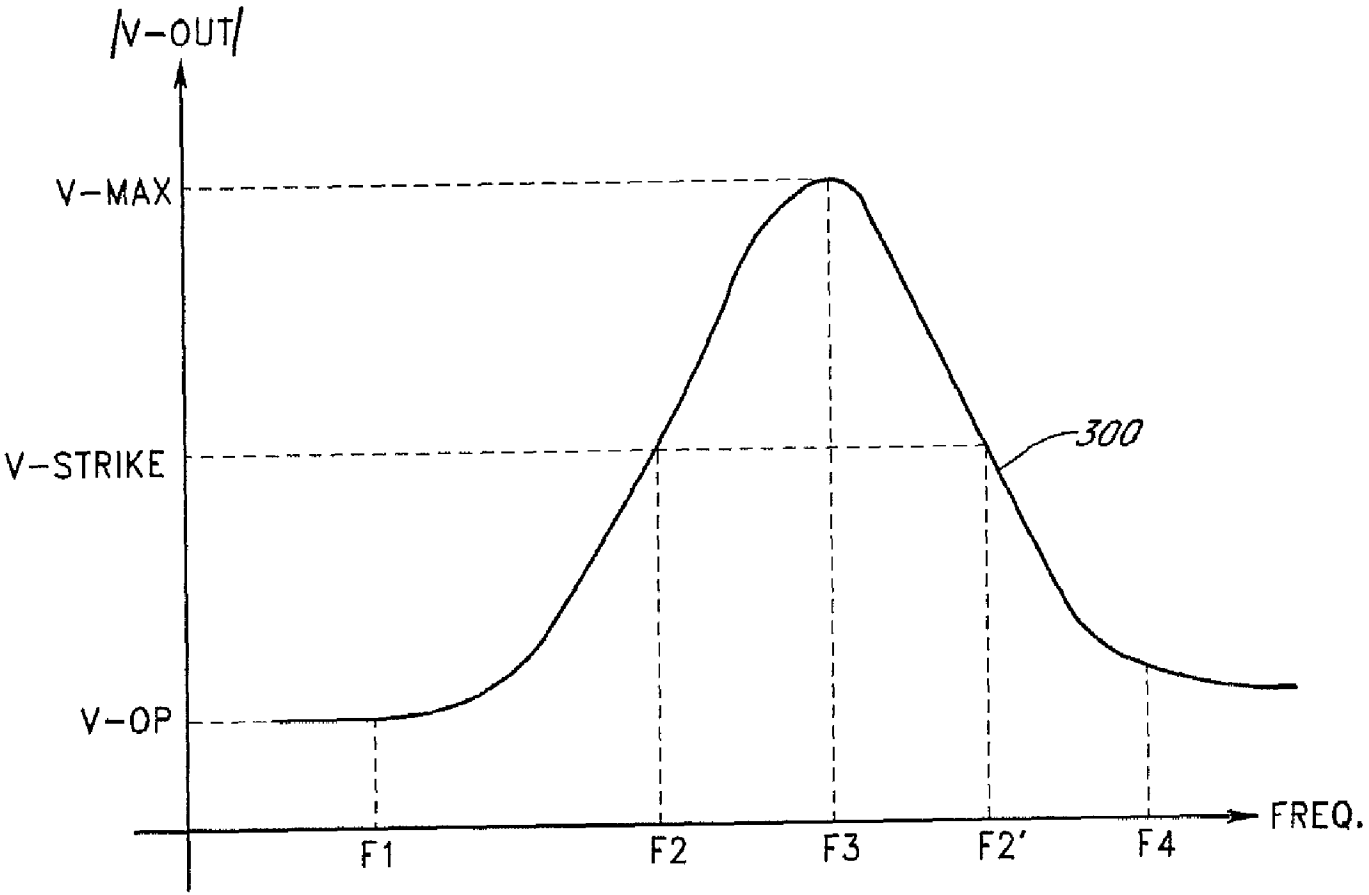
FIG. 3 illustrates output voltage amplitudes of the power conversion circuit as a function of frequency.

FIG. 3 illustrates output voltage amplitudes of the power conversion circuit as a function of frequency. A graph 300 shows the amplitude of the output voltage is relatively low at low frequencies, gradually increases with increasing frequency, reaches a peak (or maximum) at a resonant frequency (F3), and thereafter decreases with increasing frequency. The normal operating frequency (or the run frequency) of the power conversion circuit is normally maintained at a relatively low frequency (F1), such as 60 kHz-150 kHz, corresponding to a relatively low output voltage (V-OP). However, when the CCFL 112 does not strike and thus does not draw current and illuminate, it is possible to increase the voltage across the CCFL 112 in order to cause the CCFL 112 to strike by increasing the operating frequency of the power conversion circuit.

The maximum output voltage (V-MAX) corresponding to the resonant frequency (F3) may not be necessary to provide a sufficient voltage (i.e., a striking voltage) to strike the CCFL 112. The striking voltage may be less than the maximum output voltage. Thus, in one embodiment of the power conversion circuit, the operating frequency is gradually increased from the run frequency (F1) to a striking frequency (F2) corresponding to the striking voltage (V-STRIKE) during an ignition process and maintained at the striking frequency to continuously apply the striking voltage to the CCFL 112 until the CCFL 112 ignites. The power conversion circuit uses voltage feedback to stop the operating frequency from sweeping once the striking voltage is reached for more efficient operation while providing reliable ignition of the CCFL 112.

Figure 4:
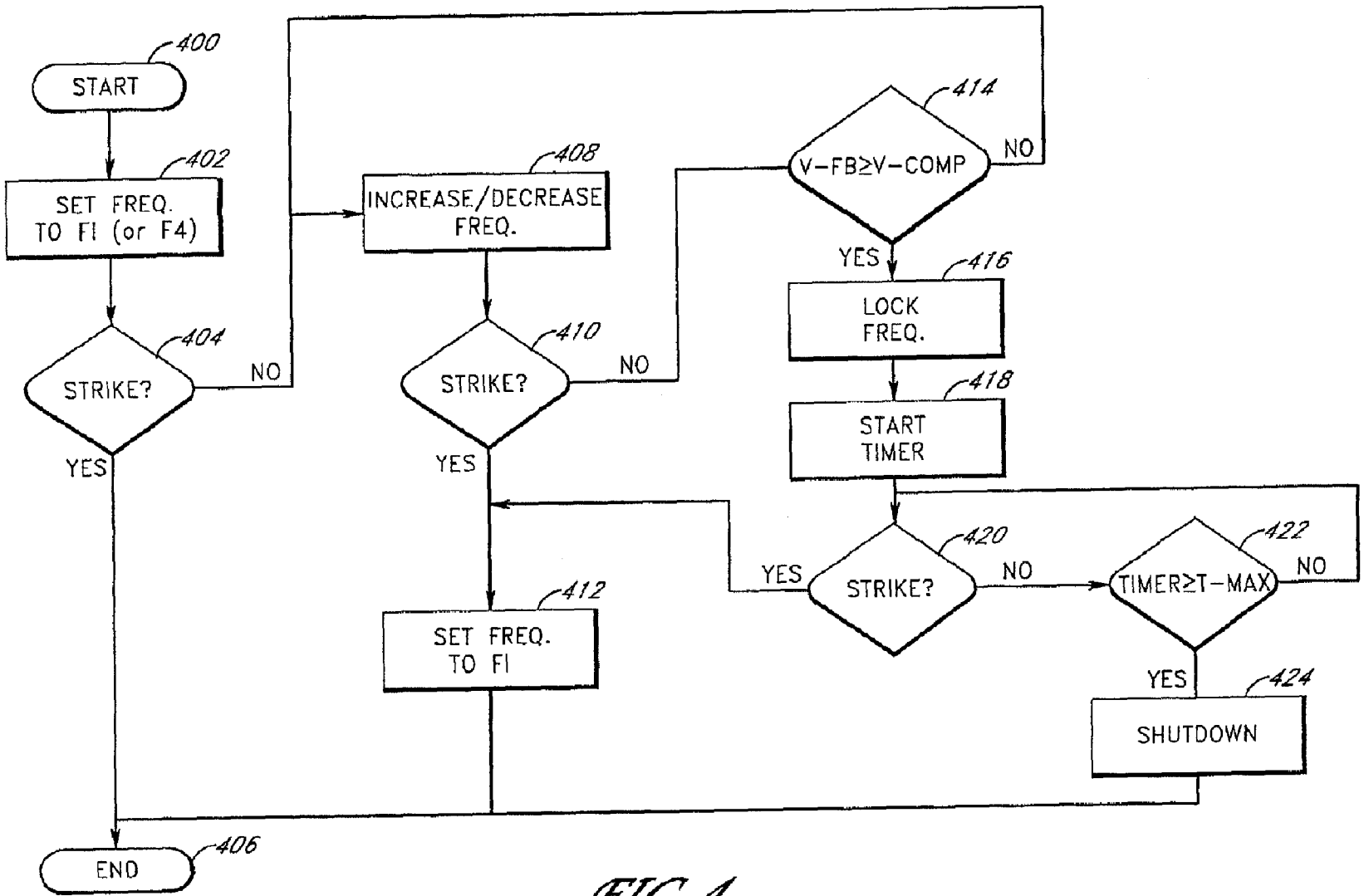
FIG. 4 is a flow chart of one embodiment of an ignition process for the power conversion circuit.

FIG. 4 is a flow chart of one embodiment of an ignition process for a power conversion circuit (or a lamp inverter). The lamp inverter advantageously provides the ignition process (or the lamp striking mode of operation) in which the output voltage is increased when a CCFL is not operating and no current is flowing. By increasing the output voltage, the CCFL can be caused to strike and draw current. When current through the CCFL is sensed, the voltage is then lowered to a normal operating voltage. The output voltage is caused to increase by increasing the operating frequency of the lamp inverter. After the CCFL has struck, the output voltage is returned to normal by lowering the operation frequency to the normal operating frequency.

The ignition process can be started at step 400 after power up, after a predetermined delay of the power up or when an enable signal is provided to the lamp inverter. The ignition process begins by setting the operating frequency of the lamp inverter to a normal run frequency (F1) at step 402.

At step 404, the ignition process determines if a CCFL coupled to the output of the lamp inverter is ignited. For example, a strike detect circuit can monitor lamp current pulses to determine if the CCFL is lighted. In one embodiment, the CCFL is considered lighted if a predetermined number of pulses (e.g., 8 or 16) above a predefined threshold is detected. If the strike detect circuit determines that the CCFL is lighted, the ignition process ends at step 406 and the lamp inverter begins normal operations.

If the strike detect circuit determines that the CCFL has not lighted at step 404, the ignition process begins sweeping the operating frequency while monitoring the status of the CCFL. For example, the ignition process increases the operating frequency at step 408 and checks for ignition of the CCFL at step 410. If step 410 determines that the CCFL is not ignited, the ignition process proceeds to step 414 to determine if a feedback voltage is greater than or equal to a comparison voltage indicating that a striking voltage at the output of the lamp inverter is reached. If the striking voltage has not been reached at step 414, the ignition process goes back to step 408. If step 410 determines that the CCFL is ignited, the ignition process continues to step 412 to reset the operating frequency of the lamp inverter to the normal run frequency, and the ignition process ends at step 406.

If step 414 determines that the striking voltage is reached, the ignition process proceeds to step 416 which locks the operating frequency to continuously provide the striking voltage at the output of the lamp inverter. A timer is started at step 418. Then the ignition process enters into an iterative process of checking for ignition of the CCFL at step 420 and checking for the timer to reach a predetermined duration at step 422. Any time step 420 determines that the CCFL is ignited, the ignition process continues to step 412.

Any time step 422 determines that the timer reaches or surpasses the predetermined duration, the ignition process proceeds to step 424 which shuts down the lamp inverter, and the ignition process ends at step 406. Shutting down the lamp inverter after the predetermined duration avoids overheating the transformer in the lamp inverter as a result of continuous high frequency operation. In one embodiment, the predetermined duration is chosen so that the strike voltage is supplied for a sufficient time to insure that a CCFL with worst case characteristics will strike at any temperature (e.g., approximately one to two seconds). If the CCFL fails to ignite after the predetermined duration, the lamp inverter automatically shuts down and may provide a status signal indicating that the CCFL is open or broken.

Figure 5:
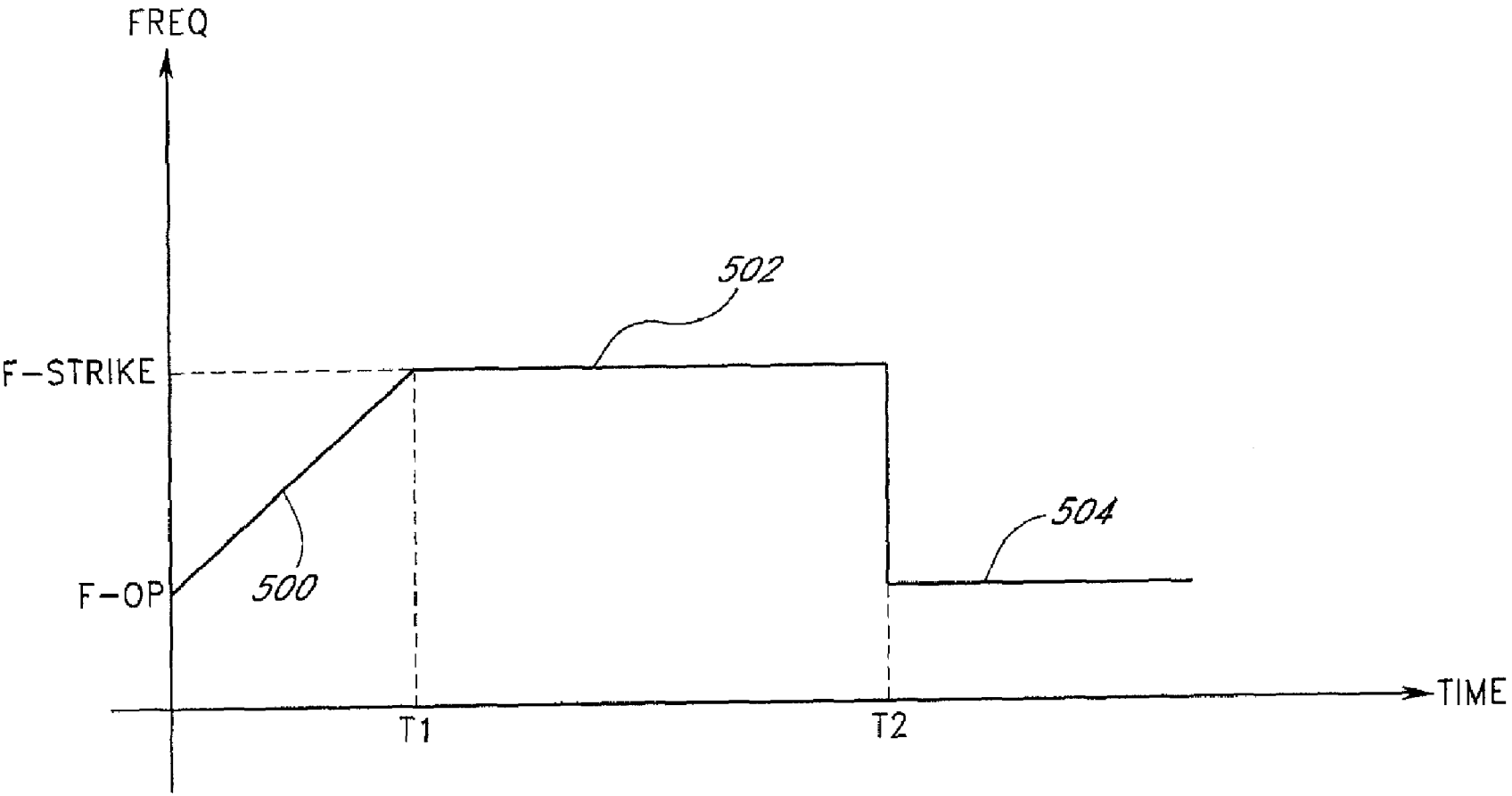
FIG. 5 illustrates a timing diagram that shows one possible frequency sequence during the ignition process.

FIG. 5 illustrates a timing diagram that shows one possible frequency sequence during the ignition process (or the lamp striking sequence) for a lamp inverter. A first segment 500 shows a linear frequency sweep from a normal operating frequency (F-OP) at time zero to a striking frequency (F-STRIKE) at time T1. A second segment 502 shows locking or holding the frequency at the striking frequency from time T1 to time T2. A third segment 504 shows reverting back to the normal operating frequency after time T2.

A strike detector may detect that a CCFL is not drawing current at time zero and enables a lamp striking sequence. The lamp striking sequence automatically ramps the operating frequency of the lamp inverter until time T1 when the increasing frequency results in a voltage (i.e., a striking voltage) sufficient o strike the CCFL. The lamp striking sequence stops ramping the operating frequency at T1 to continuously apply the striking voltage to the CCFL until time T2 when the CCFL strikes. A voltage feedback signal indicative of the output voltage level can be used to lock the operating frequency corresponding to the striking voltage. The striking voltage is provided at 100% duty cycle during the time interval between T1 and T2 (i.e., the strike interval) to result in quicker lamp striking. At time T2, the lamp striking sequence is automatically disabled so that the striking voltage is no longer applied to the CCFL.

Although described above in connection with CCFLs, it should be understood that a similar apparatus and method can be used to drive fluorescent lamps having filaments, neon lamps, and the like.

The presently disclosed embodiments are to be considered in all respect as illustrative and not restrictive. The scope of the invention being indicated by the append claims, rather than the foregoing description, and all changes which comes within the meaning and ranges of equivalency of the claims are therefore, intended to be embrace therein.

What is claimed is:

1. A controller for an inverter that powers a fluorescent lamp, the controller comprising:

a first input terminal configured to receive a voltage feedback signal indicative of an AC output voltage provided to the fluorescent lamp;

a second input terminal configured to receive a current feedback signal indicative of an AC lamp current conducted by the fluorescent lamp, wherein the fluorescent lamp is considered lit when a predetermined number of consecutive periodic cycles in the AC lamp current exceed a predefined amplitude and is otherwise considered unlit during a strike mode to ignite the fluorescent lamp;

an output terminal configured to provide a driving signal to a switching circuit that generates the AC output voltage from a DC input source;

a strike circuit configured to generate a timing signal based on the voltage feedback signal and the current feedback signal to control a frequency of the driving signal, wherein the timing signal varies the frequency of the driving signal to increase the AC output voltage when the voltage feedback signal indicates that the AC output voltage is less than a predefined striking level and the fluorescent lamp is considered unlit, holds the frequency of the driving signal at a substantially constant strike frequency associated with the AC output voltage reaching the predefined striking level while the fluorescent lamp is considered unlit, and shifts the frequency of the driving signal to a normal operating frequency that is different from the substantially constant strike frequency when the fluorescent lamp is considered lit; and a driver circuit configured to generate the driving signal based at least in part on the timing signal.

2. The controller of claim 1, wherein the strike circuit is further configured to generate a fault signal to disable the driving signal when the frequency of the driving signal is held at the substantially constant strike frequency for longer than a predetermined duration.

3. The controller of claim 1, wherein the driver circuit comprises an oscillator and the timing signal is a control signal provided to an input of the oscillator.

4. The controller of claim 1, wherein the driver circuit comprises a pulse width modulator to vary a pulse width of the driving signal.

5. The controller of claim 1, wherein the substantially constant strike frequency is higher than the normal operating frequency.

6. The controller of claim 1, wherein the substantially constant strike frequency is lower than the normal operating frequency.

7. The controller of claim 1, wherein the AC output voltage has approximately the predefined striking level when the frequency of the driving signal is at the substantially constant strike frequency.

8. The controller of claim 1, wherein the strike circuit comprises:

a first comparator circuit configured to receive the voltage feedback signal and to generate a first logic signal that has a first state when the voltage feedback signal has an amplitude that is less than a predefined comparison level and has a second state when the voltage feedback signal has an amplitude that is greater than the predefined comparison level, wherein the voltage feedback signal has an amplitude that is approximately equal to the predefined comparison level when the AC output voltage reaches the predefined striking level;

a second comparator circuit configured to receive the current feedback signal and to generate a second logic signal that has a pulse when the current feedback signal crosses a predefined threshold;

a strike detector circuit configured to monitor the second logic signal and to output a strike detect signal to indicate that the fluorescent lamp is lit when the second logic signal has at least a predetermined number of consecutive pulses; and a timing generator circuit configured to generate the timing signal based at least in part on the first logic signal and the strike detect signal.

9. The controller of claim 8, wherein the strike circuit further comprises a fault detector circuit configured to determine a fault condition based on the first logic signal and the strike detect signal and to generate a fault signal to disable the driving signal in response to the fault condition.

10. The controller of claim 9, wherein the fault detector circuit comprises a timer that starts when the first logic signal transitions from the first state to the second state and expires after a predetermined time interval, and the fault condition is determined when the timer expires before the strike detect signal indicates that the fluorescent lamp is lit.

11. The controller of claim 8, wherein the first comparator circuit comprises:

a full-wave rectifier configured to receive the voltage feedback signal and to generate an intermediate feedback voltage reflective of the amplitude of the voltage feedback signal; and a voltage comparator configured to compare the intermediate feedback voltage with a comparison voltage associated with the predefined comparison level to generate the first logic signal.

12. The controller of claim 8, wherein the second comparator circuit comprises:

a current limiting resistor with a first terminal coupled to the current feedback signal and a second terminal coupled to an intermediate node;

a clamping diode coupled between the intermediate node and a reference potential;

a voltage comparator configured to output the second logic signal; and a threshold voltage coupled between the intermediate node and an input of the voltage comparator.

13. The controller of claim 8, wherein the timing generator circuit comprises an oscillator, the driver circuit comprises a pulse width modulator, and the timing signal is a periodic ramp signal that is provided to the pulse width modulator.

14. A method to control striking of a fluorescent lamp, the method comprising:

monitoring an AC output voltage across the fluorescent lamp;

determining whether the fluorescent lamp is lit based on an AC lamp current conducted by the fluorescent lamp, wherein the fluorescent lamp is considered unlit when the AC lamp current is less than a predetermine amplitude and is considered lit when the AC lamp current exceeds the predetermine amplitude for a predetermined number of consecutive cycles;

sweeping a frequency of a driving signal from an initial frequency to a striking frequency to increase the AC output voltage when the fluorescent lamp is unlit and the AC output voltage is less than a predefined level, wherein the AC output voltage has approximately the predefine level when the frequency of the driving signal is at the striking frequency;

maintaining the frequency of the driving signal at the striking frequency until either the fluorescent lamp is considered lit or a time-out period expires; and changing the frequency of the driving signal from the strike frequency to a run frequency if the fluorescent lamp is considered lit, wherein the run frequency is different from striking frequency.

15. The method of claim 14, further comprising disabling the driving signal if the time-out period expires before the fluorescent lamp is considered lit.

16. The method of claim 14, wherein the initial frequency and the run frequency are substantially similar and predetermined.

17. The method of claim 14, wherein the initial frequency is lower than the striking frequency.

18. The method of claim 14, wherein the initial frequency is higher than the striking frequency.

19. An inverter controller comprising:

means for tracking an AC output voltage;

means for tracking an AC output current;

means for varying a frequency of a driving signal to increase the AC output voltage when the AC output voltage is less than a predefined level and the AC output current is less than a predefined amplitude;

means for locking the frequency of the driving signal to a substantially constant locked frequency when the AC output voltage reaches the predefined level and the AC output current is less than the predefined amplitude; and means for changing the frequency of the driving signal from the substantially constant locked frequency to a normal operating frequency when the AC output current is greater than the predefined amplitude for at least a predetermined number of consecutive cycles, wherein the normal operating frequency is different from the substantially constant locked frequency.

20. The inverter controller of claim 19, further comprising means for indicating a fault condition to disable the driving signal when the frequency of the driving signal is locked to the substantially constant locked frequency for longer than a predefined time period.

* * * * *